US012162668B2

(12) United States Patent
Olberding et al.

(10) Patent No.: US 12,162,668 B2
(45) Date of Patent: Dec. 10, 2024

(54) PRESSURE CONTAINER OF PLASTIC

(71) Applicant: ALPLA WERKE ALWIN LEHNER GMBH & CO. KG, Hard (AT)

(72) Inventors: Thomas Olberding, Lohne (DE); Florian Müller, Hard (AT); Tim Silbermann, Kobenhavn K (DK); Markus Salzmann, Dornbirn (AT); Oliver Unterlechner, Bregenz (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 334 days.

(21) Appl. No.: 17/144,916

(22) Filed: Jan. 8, 2021

(65) Prior Publication Data

US 2021/0130079 A1 May 6, 2021

Related U.S. Application Data

(63) Continuation of application No. PCT/EP2019/064482, filed on Jun. 4, 2019.

(30) Foreign Application Priority Data

Jul. 9, 2018 (CH) ..... 00853/18

(51) Int. Cl.
*B65D 83/64* (2006.01)
*B65D 83/38* (2006.01)
*B65D 83/42* (2006.01)

(52) U.S. Cl.
CPC ..... *B65D 83/64* (2013.01); *B65D 83/38* (2013.01); *B65D 83/42* (2013.01)

(58) Field of Classification Search
CPC ..... B65D 83/64; B65D 83/38; B65D 83/42
(Continued)

(56) References Cited

U.S. PATENT DOCUMENTS 4,955,492 A 9/1990 Behm et al.
5,069,368 A * 12/1991 Godard ..... B05B 11/00416 222/402.1
(Continued)

FOREIGN PATENT DOCUMENTS

EP 1725476 B1 10/2007
EP 2791030 B1 * 5/2016
(Continued)

OTHER PUBLICATIONS

Machine translation of FR 2713299 (Year: NA).*
(Continued)

*Primary Examiner* — Jeremy Carroll
(74) *Attorney, Agent, or Firm* — Buchanan Ingersoll & Rooney PC

(57) ABSTRACT

A plastic pressure container has an essentially cylindrical container body with an opening closable in a pressure-tight manner by a valve attachment for dispensing a filling product. An interior plunger is arranged in a longitudinally displaceable manner along a longitudinal axis to subdivide the container body into a receiving chamber adjacent to the opening for the filling product and into a separated reservoir in a pressure tight manner, for a pressure medium. The plunger includes two circumferential sealing lips separated in the axial direction. An upper sealing lip extends into the receiving chamber and a lower sealing lip extends into the reservoir, and these are pressed in a fluid-tight manner onto an inner wall which delimits the interior of the container body, by pressure in the receiving chamber and reservoir.

28 Claims, 3 Drawing Sheets

(58) Field of Classification Search
USPC ..... 222/389, 402, 394, 386.5, 402.1, 402.21
See application file for complete search history.

(56) References Cited

U.S. PATENT DOCUMENTS

| | | | | |
|---|---|---|---|---|
| 5,206,062 | A * | 4/1993 | Amemiya | C08L 55/02 428/36.6 |
| 5,553,753 | A * | 9/1996 | Abplanalp | B65D 83/38 222/387 |
| 6,230,943 | B1 * | 5/2001 | Miyamoto | B65D 83/646 222/402.1 |
| 9,334,103 | B2 * | 5/2016 | Soliman | B65D 83/38 |
| 11,059,658 | B2 * | 7/2021 | Brouwer | B29C 65/1635 |
| 2001/0015359 | A1 * | 8/2001 | Benoist | B65D 83/62 222/329 |
| 2005/0218103 | A1 * | 10/2005 | Barker | B29B 11/12 215/44 |
| 2007/0125809 | A1 | 6/2007 | Regan et al. | |
| 2015/0202818 | A1 * | 7/2015 | Marin | B29C 49/06 264/537 |
| 2017/0036848 | A1 * | 2/2017 | Chury | B29C 66/54 |
| 2018/0200744 | A1 * | 7/2018 | Aworth | B05B 9/0883 |
| 2018/0229920 | A1 * | 8/2018 | Vanderstraeten | B65D 83/38 |
| 2018/0370150 | A1 * | 12/2018 | Brouwer | B29C 65/1654 |
| 2021/0162725 | A1 * | 6/2021 | Krizan | B32B 27/304 |

FOREIGN PATENT DOCUMENTS

| | | | | |
|---|---|---|---|---|
| FR | 2713299 | A1 * | 6/1995 | B65D 83/0005 |
| JP | 2007505251 | A | 3/2007 | |
| WO | WO 01/21507 | A1 * | 3/2001 | |
| WO | WO 2005/082744 | A1 * | 9/2005 | |
| WO | 2007010561 | A1 | 1/2007 | |
| WO | WO 2017/080678 | * | 5/2017 | |
| WO | WO-2017112977 | A2 * | 7/2017 | |

OTHER PUBLICATIONS

International Search Report (with English Translation) and Written Opinion issued in corresponding International Patent Application No. PCT/EP2019/064482, 14 pages (Sep. 2, 2019).

CN Office Action issued in CN Application No. 201980045740; Mailed Mar. 8, 2022. 15 Pages (with English Translation).

* cited by examiner

PRESSURE CONTAINER OF PLASTIC

RELATED APPLICATION

This application claims priority as a continuation application under 35 U.S.C. § 120 to PCT/EP2019/064482, which was filed as an International Application on Jun. 4, 2019 designating the U.S., and which claims priority to Swiss Application 00853/18 filed in Switzerland on Jul. 9, 2018. The entire contents of these applications are hereby incorporated by reference in their entireties.

FIELD

The present disclosure relates to a pressure container of plastic.

BACKGROUND INFORMATION

Containers of tin sheet or aluminium sheet, of glass or also of ceramic, such having been common in the past, are being increasingly replaced by containers of plastic. Such containers are particularly for the packaging of fluid substances, for example for applications in the household, in agriculture, industry or commerce etc., where it is recently predominantly plastic containers which are applied. The low weight and the lower costs of course play a significant role in such a substitution. The use of recyclable plastic materials and the overall more favourable total energy balance on their manufacture also contribute to encouraging the acceptance of plastic containers by the users.

Plastic containers of polyethylene terephthalate (PET) and similar materials are mostly manufactured in a so-called stretch blow moulding method. Herein, a preform is firstly manufactured in an injection mould in an injection moulding method. Recently, compression moulding methods or also extrusion blow moulding methods have also been suggested for the manufacture of preforms. The preform has an essentially elongate preform body and is designed in a closed manner at its one longitudinal end. For example, an injection point which originates from the injection moulding is also to be found there. A neck section which is provided with a pour-out opening connects onto the other end of the preform body. The neck section already has the later shape of the container neck. Concerning many of the known preforms, the preform body and the neck section are separated from one another by way of a so-called support ring. The support ring projects radially away from the neck wall, and serves for the transport of the preform or of the plastic container which is manufactured therefrom and for the support of the preform on the blow moulding tool or of the plastic container on closing this.

After its manufacture, the preform is removed from the mould and, still hot, can be immediately processed further in a single-stage stretch blow moulding method. Given a two-stage stretch blow moulding method, the preform is cooled and intermediately stored for a spatially and or temporally separate further processing on a stretch blow moulding device. The preform is then conditioned where necessary before the further processing in a stretch blow moulding device, e.g., a temperature profile is imparted upon the preform. It is subsequently brought into a blow mould of a stretch blow moulding device. In the blow mould, the preform is finally inflated according to the mould cavity by way of a gas, such as air, which is blown in at overpressure, and is herein additionally stretched by a stretching mandrel.

An injection blow moulding method, concerning which the stretch blowing process is effected directly subsequently to the injection of the preform, is known. Herein, the preform remains on the injection core which at the same time forms a type of stretching mandrel. Again by way of overpressure, the preform is inflated according to the mould cavity of a blow mould which is extended onto the injection core or vice versa and herein is stretched by the stretching mandrel. The finished plastic container is subsequently removed from the mould. Stretch blow moulded or injection blow moulded plastic containers can be identified by way of the injection point which can be arranged in the region of the container base, and originates from the preform, and in which the plastic material has only been slightly stretched or even not at all.

Pressure containers for gases, liquids, pasty masses or similar filled goods are mostly still manufactured of metal. Above all, this is because the metallic pressure container has high shape stability and can also withstand high inner pressures. Since, with regard to such pressure containers, the interior can be subdivided into two chambers by way of a plunger which is displaceably mounted along a longitudinal axis of the pressure container, the chambers being separated from one another in a pressure-tight manner and having to remain so, high demands are placed on the roundness of the inner wall, along which the plunger is displaceable. Pressure containers of metal are adequately shape-stable, in order to ensure this roundness. However, pressure containers of metal can also be regionally deformed due to external mechanical action, for example by way of a blow, and this can lead to longitudinal displacement of the plunger.

Pressure containers of plastic which analogously to the pressure containers of metal are separated into two chambers by way of a plunger which is arranged in a longitudinally displaceable manner within the container have already been described. The described pressure containers include for example polyethylene terephthalate (PET). The base of the pressure container is separated away, in order to insert the plunger. A specially designed base part is subsequently inserted into the cut end region of the pressure container, in order to close this in a pressure-tight manner. Such pressure containers of plastic are relatively complicated in manufacture. The specially designed base part is a separate component which creates additional costs. The pressure-tight connecting of the separate base part to the cut end region of the pressure container entails additional effort. Disregarding this, the pressure-tight separation of the two chambers in the pressure container is not simple to realise. For this, it is very often desired and/or necessary to calibrate the inner wall of the pressure container, along which inner wall the plunger is longitudinally displaceable, so that the demanded roundness of the pressure container is ensured. The additional calibration of the inner wall is an expensive procedure and is probably also the reason why such pressure containers of plastic can hardly be found on the market.

SUMMARY

A pressure container of plastic is disclosed, comprising: an essentially cylindrical container body whose one longitudinal end includes an opening which is closable in a pressure-tight manner by a valve attachment which is configured and designed for dispensing a gaseous, liquid, powder-like, pasty or similar filling product, and whose interior, by way of a plunger which is arranged in a longitudinally displaceable manner along a longitudinal axis of the container body, is subdivided into a receiving chamber which is adjacent to the opening for the filling product and into a reservoir which is separated from this in a pressure tight manner and which is closed in a pressure-tight manner by a base part, for a pressure medium, the container body being a hollow blow molded body; and a plunger which includes two circumferential sealing lips which are distanced from one another in an axial direction, wherein an upper sealing lip extends into the receiving chamber and a lower sealing lip extends into the reservoir, wherein the upper and the lower sealing lips are pressed or are pressable in a fluid-tight manner onto an inner wall, which delimits the interior of the container body, by way of a pressure which prevails in the receiving chamber and in the reservoir.

BRIEF DESCRIPTION OF THE DRAWINGS

Further advantages and features result from the subsequent description of exemplary embodiments with reference to the schematic drawings. In schematic representations which are not true to scale.

For reasons of a better understanding of the invention, the same components and construction parts are each provided with the same reference numerals in the exemplary embodiment illustrations of FIG. 1 to FIG. 4.

DETAILED DESCRIPTION

Figure 1:
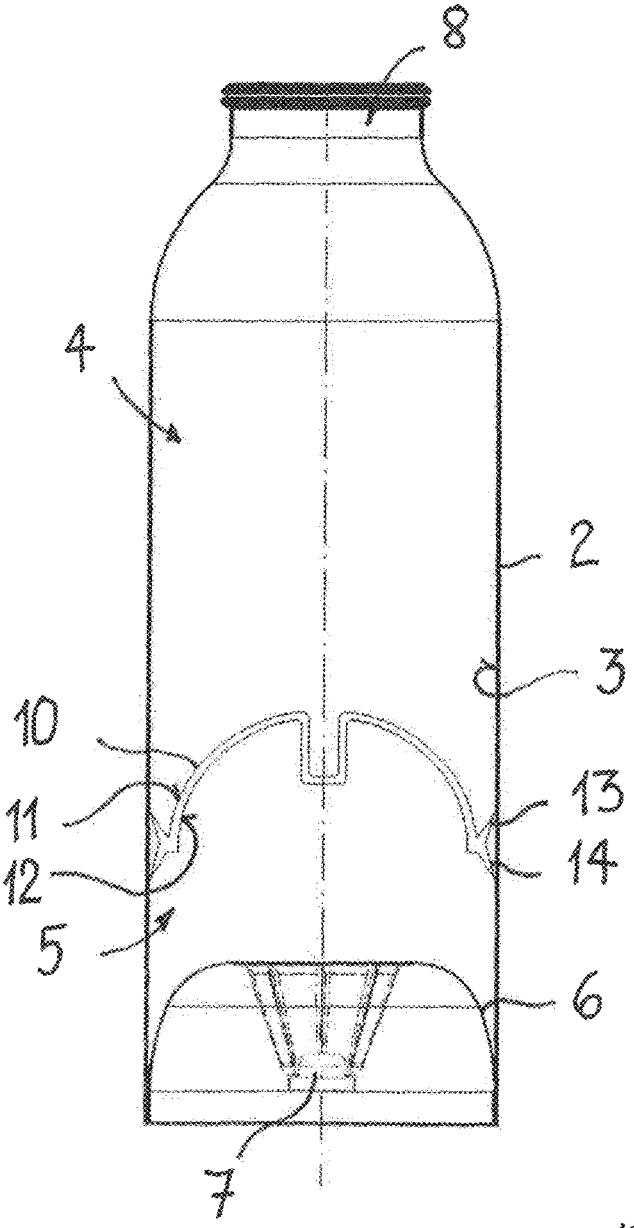
FIG. 1 is an axially sectioned representation of a first exemplary embodiment of a pressure container.

A pressure container for gases, liquids, pasty masses and similar filled goods is disclosed, which can be simple and inexpensive to manufacture. One should be able to make do without a calibration of the inner wall of the pressure container.

A pressure container of plastic, in particular for an aerosol is disclosed herein, the container having for example an essentially cylindrical container body. One longitudinal end of the container body includes an opening which is closable in a pressure-tight manner by a valve attachment which is configured and designed for dispensing a gaseous, liquid, powder-like, pasty or similar filling product. An interior of the container body, by way of a plunger which is arranged in a longitudinally displaceable manner along a longitudinal axis of the container body, is subdivided into a receiving chamber which is adjacent to the opening, for the filling product and into a reservoir which is separated from this in a pressure tight manner, for a pressure medium. The reservoir is closed in a pressure-tight manner by way of a base part. The container body is configured and designed as a hollow body which is manufactured in a blow moulding method. The exemplary plunger includes two circumferential sealing lips which are distanced to one another in the axial direction, wherein an upper sealing lip extends into the receiving chamber and a lower sealing lip extends into the reservoir. The upper and the lower sealing lip can be pressed or are pressed in a fluid-tight manner onto an inner wall which delimits the interior of the container body, by way of a pressure which prevails in the receiving chamber and in the reservoir.

The plunger which is arranged in the container body of the pressure container can have an outer contour which essentially corresponds to an inner contour of the container body. Herein, the plunger can be configured and designed in an essentially cylindrical manner and supported on an inner wall of the container body which encompasses the interior, via the two circumferential sealing lips which are axially distanced to one another. It is to be understood that the container body can also have a cross section which differs from the circular shape. In accordance with exemplary embodiments, what can be essential is that the plunger which is arranged in the container interior in an axially displaceable manner includes an outer contour which corresponds essentially to that of the inner wall of the container body. By way of the plunger not being supported on the inner wall directly via its outer wall but via the two sealing lips, the demands on the dimensional accuracy of the inner wall can be kept low. The sealing lips ensure a position of the plunger which is defined with respect to the container axis. By way of this, the conditions are created for a uniform pressing of the sealing lips onto the inner wall of the container body. The sealing lips are adequately flexible, in order to compensate smaller dimensional inaccuracies of the inner wall of the container body. The upper and the lower sealing lip are pressable or pressed in a fluid-tight manner onto an inner wall which delimits the interior of the container body, by way of a pressure which prevails in the receiving chamber and in the reservoir. By way of this, one achieves a pressure-tight separation of the receiving chamber for the filling material and of the reservoir for a pressure means, the chambers being adjacent one another.

In an exemplary embodiment of the pressure container, the plunger includes an upper delimitation surface which faces the opening, and a lower delimitation surface which faces the base part. One of the two circumferential sealing lips is assigned to the upper and one to the lower delimitation surface, wherein the upper sealing lip extends from the upper delimitation surface in the direction of the opening and to the outside in the direction of the inner wall of the container body, and the lower sealing lip extends from the lower delimitation surface in the direction of the base part and to the outside and in the direction of the inner wall of the container body. On account of the selected arrangement of the sealing lips, their inner surfaces are impinged by the pressures which prevail in the receiving container for the filling product and in the reservoir for the pressure medium, and are uniformly pressed against the inner wall of container body. A surfaced contact on the inner wall of the container body results due to the elasticity of the sealing lips, such increasing the pressure sealedness.

An exemplary embodiment of the pressure container envisages the sealing lips in the non-loaded state forming an angle of for example 45 degrees to 80 degrees with the inner wall of the container body. The sealing lips which are configured and designed in such a manner ensure a defined and centred mounting of the plunger in the container body.

Concerning an exemplary variant of the pressure container, the container body is manufactured in a stretch blow moulding method from a preform which has been previously manufactured in an injection moulding method or compression moulding method and which essentially includes (e.g., consists of) polyethylene terephthalate. Plastic containers of PET have the strengths which are desired/necessary for pressure containers. The desired/necessary stretch setting is effected in the stretch blow moulding method, in order to give the PET the demanded characteristics.

For obtaining the pressure resistance of the pressure container of PET, the container body is reshaped in the stretch blow moulding method in a manner such that it has an axial stretching ratio in an exemplary range of 1:1.5 to 1:15, in particular from for example 1:4 to 1:10 with respect to the preform.

In an exemplary embodiment of the pressure container, the container body is manufactured in a stretch blow moulding method from a preform which has been previously manufactured in an injection moulding method or compression moulding method, in a manner such that a region of the container body, over region which the plunger travels on use, has a degree of crystallisation which is equal to or larger than for example 5%, wherein the degree of crystallisation is determined via density measurements according to the standard ASTM D 1505-10 given an intrinsic viscosity of 0.75 dl/g to 1.25 dl/g which is measured according to ASTM D 4603-11. Given a degree of crystallisation in the specified range, the container body includes desired/necessary mechanical strengths and the barrier characteristics with regard to air and moisture, such characteristics being desirable/necessary for the filling material.

In an exemplary embodiment of the pressure container, the container body for this has a degree of crystallisation of for example 5% to 50%, preferably for example 20% to 30% in the region over which the plunger travels.

The determining of the density is effected according to the measuring method which is described in the standard ASTM D 1505-10, for the definition of the degrees of crystallisation which are specified above. This measuring method permits the density to be determined with an accuracy of 0.001 g and less. The measured density provides information on the orientation, the crystallisation and the strength of the constrictions. However, amorphous PET can achieve different density values in dependence on the added copolymers and/or additives. Values between 1.320 g/cm$^3$ and 1.339 g/cm$^3$ are known.

In order, despite the copolymers and/or additives which are added to the amorphous PET, to be able to use the measuring method which is described in the standard ASTM D 1505-10, in the context of the present disclosure, it is specified that an average density of the container body which is measured below the longitudinal end of the container body, on which the valve insert is assembled, represents a first reference value. Preferably, for example, the density is determined at least at three measuring points which are different from one another, along a periphery of the container body and the average density determined from this. Irrespectively of a possibly actually present crystallisation, in the context of the present disclosure, it is defined that no crystallisation is present, thus that the degree of crystallisation is 0%, at the measuring position or positions, at which the first reference value has been determined. Furthermore, in the context of exemplary embodiments disclosed herein, a second reference value can be defined, this being for example 0.120 g/cm$^3$ larger than the first determined reference value. This second reference value according to definition corresponds to a degree of crystallisation of 100%. The degrees of crystallisation which lie between the two reference values are directly proportional to the determined density values.

For example, an average density of 1.330 g/cm$^3$ is determined as the first reference value. According to the above definition, this average density corresponds to a crystallisation degree of 0%. According to definition, the crystallisation degree of 100% lies at a density of 1.450 g/cm$^3$ which represents the second reference value. On account of the direct proportionality between the density values and the crystallisation degrees, the degree of crystallisation degree at a density of 1.360 g/cm$^3$ is then 25%, at a density of 1.390 g/cm$^3$ is 50% and at a density of 1.420 g/m$^3$ is 75%.

Concerning an alternative exemplary pressure container, the container body can be manufactured in an injection blow moulding method from a preform which has been previously manufactured in an injection moulding method or compression moulding method. The container body can also manufactured in an extrusion blow moulding method.

In an exemplary embodiment of the pressure container, the stretch blow moulded or injection blow moulded container body is manufactured from a preform which for the most part, thus for example at 90% and more, includes a plastic from the group consisting of PET, PVC, copolymers of the specified plastics, bio-plastics such as e.g. PLA, PEF or PPF, filled plastics and/or mixtures of the mentioned plastics.

Concerning pressure containers which include an extrusion blow moulded container body, the container body for the most part, thus for example at 90% and more, includes a plastic from the group consisting of HDPE, PP, PET-X, PET-G, copolymers of the specified plastics, bio-plastics such as e.g. PLA, PEF, or PPF, filled plastics and/or mixtures of the mentioned plastics.

Concerning an exemplary embodiment of the pressure container, the container body includes (e.g., consists of) an uncoloured plastic. A crystal clear container body is achieved due to making do without the admixing of a dye, e.g. in the case of PET. The recyclability of the pressure container can be improved even more by way of this.

In order to increase the storage durability of the filled pressure container, in an exemplary embodiment the plunger includes a barrier layer which prevents a passage of the pressure medium from the reservoir to the receiving chamber. On using compressed air as a pressure medium and given filling products which can degrade on contact with air, e.g. with ketchup, various spice sauces and spice pastes, etc., here it is the case of a barrier layer which prevents a passage of oxygen through the plunger. The barrier layer can be configured and designed as a layer from the group consisting of EVOH layer, EVAL layer, a layer based on polyamide, lacquer coating, silicon oxide coating, aluminium oxide coating, coating from silicones and combinations of the mentioned coatings.

The barrier layer can be deposited onto the plunger by way of sputtering. In an alternative embodiment variant of the pressure container, this can comprise a plunger which is manufactured in an injection moulding method or in a compression moulding method, and wherein the barrier layer is deposited during the manufacture of the plunger, for example in a 2-component injection moulding method. Given the application of a so-called co-injection method, the barrier layer can also be simultaneously brought into the core of the flow channel in a simultaneous manner in an injecting procedure. In this case, the barrier layer is brought into or embedded into the plastic material of the plunger.

The recyclability of the pressure container can also be increased by way of the plunger for the most part, thus for example at 90% or more including the same plastic as the container body.

In an exemplary embodiment, the upper and/or the lower sealing lip includes (e.g., consists of) a reversibly elastic material, such as e.g., silicone, rubber, EPDM, FKM. The reversible elasticity of the sealing lip(s) simplifies the compensation of unevenness of the inner wall of the container body which does not need to be calibrated. As a result of the elasticity of the sealing lips, their free end regions which bear on the inner wall come into surfaced contact on the inner wall of the container body due to the pressure of the pressure medium or of the filling product, which increases the pressure sealedness.

By way of the valve attachment being composed of components which for the most part, thus for example at 90% and more include the same plastic as the container body, as in an exemplary embodiment of the pressure container, the recyclability of the pressure container can be improved even further. The sameness of the material pairings of the container body and of the valve attachment which can be placed upon the opening furthermore simplifies the creation of a pressure-tight connection between the two joining partners.

Concerning an exemplary embodiment of the pressure container, the base part is formed by a base section which has previously been separated from the container body and which is inserted into a cut end of the container body which lies opposite the opening, in a manner such that a container base of the base section lies closer to the plunger than the cut end of the container body. By way of the base section which is separated away from the container body being used as a base part, the manufacture of a separate base part is done away with. The separated-away base section and the container body include (e.g., consist of) the same plastic material. For this reason, incompatibilities which are inherent of the material are also done away with, for example due to the base part consisting of a different plastic than the container body, which could lead to difficulties at the pressure-tight connection of the base part with the cut end section of the container body. The dimensional accuracy of the base part also does not represent a problem, because the separated-away base section at the cut edge has the same diameter as the container body. The base section can be separated away at a location of the longitudinal extension of the container body, from which location the outer diameter reduces in size. By way of this, the base section can be inserted very simply into the cut end of the container body in a reverse orientation, with the base in front. The correct axial placing compellingly results due to the same outer diameter at the cut edges of the container base or base section.

However, the base part can also be manufactured as a separate part in an injection moulding method. Herein, the base part is expediently manufactured of a plastic which is compatible with the plastic material of the container body. An exemplary embodiment envisages the base part for the most part, thus for example at 90% and more, including (e.g., consisting of) the same plastic as the container body. This simplifies the pressure-tight connection between the container body and the base part.

An exemplary variant of the pressure container envisages the pressure-tight connection between the container body and the base part being created in a welding method. Various plastic welding methods are known from the state of the art. For example, a so-called clear-clear laser welding method has been described for plastic containers of PET, said method being able to lead to adequately strong material-fit connections.

An alternative exemplary embodiment envisages the pressure-tight connection between the base part and the cut end of the container body being created in a friction welding method or in an ultrasonic welding method. As a result of material pairing of the joining partners being of the same type, a local melting of the joining partners in the joining region is sufficient, in order to create a material connection which has the necessary pressure resistance.

In an exemplary embodiment, the base part and the container body can also be connected to one another in a pressure-tight manner by way of bonding.

In order for the container body of the pressure container to have the desired/necessary intrinsic stiffness and pressure resistance, the container body can have a wall thickness of for example 0.35 mm to 0.95 mm at least in the region, over which the plunger travels on application. With regard to these wall thicknesses, an adequate intrinsic stiffness is ensured even in the case of unfavourable storage conditions. On the other hand, the economicability of the manufacture of the pressure container is not compromised by the quantity of plastic material which is desirable for achieving the wall thicknesses.

An exemplary embodiment of the pressure container envisages the opening being closed in a pressure-tight manner by the valve attachment, the receiving chamber of the container body being filled with a gaseous, liquid, powder-like, pasty or similar filling material, and the reservoir for the pressure medium containing a non-combustible gas or gas mixture such as for example in particular air, nitrogen, carbon dioxide or an inert gas which is held at a pressure of 1.5 to 10 bar.

Referring to the figures, a first exemplary embodiment of a pressure container is represented in an axial section in FIG. 1 and in its entirety is provided with the reference numeral 1. The pressure container includes a container body 2 whose interior which is closed by the container body 2 is subdivided by way of an inserted, axially displaceable plunger 10 into a receiving chamber 4 for a gaseous, liquid, powder-like, pasty or similar filling product and into a reservoir 5 which is separated from this in a pressure-tight manner, for a pressure medium. The reservoir 5 is closed in a pressure-tight manner by a base part 6. A plug 7 which for filling the reservoir 5 with the pressure medium can be pierced a needle or the like is inserted in the base part 6 in a roughly centrically arranged manner. Herein, it is for example the case of a rubber plug with a septum and the like. The container body 2 at the longitudinal end which is away from the base part 6 includes an opening 8 which is closable in a pressure-tight manner by a valve attachment which is designed for dispensing a gaseous, liquid, powder-like, pasty or similar filling product. This is effected after the filling of the receiving chamber 4 with the filling product. For reasons of a better overview and since this is not essential to the invention, a representation of the valve insert has been omitted.

The container body 2 can be manufactured in a blow moulding method. Herein, it is above all stretch blow moulding and injection blow moulding which are considered, concerning which the container body 2 is manufactured from a previously injection moulded or flow press moulded preform. However, the container body 2 can also be manufactured in an extrusion blow moulding method.

Stretch blow moulded or injection blow moulded container bodies for the most part, thus for example at 90% and more include a plastic from the group consisting of PET, PVC, copolymers of the specified plastics, bio-plastics such as e.g. PLA, PEF or PPF, filled plastics and/or mixtures of the mentioned plastics.

Concerning pressure containers which include an extrusion blow moulded container body, the container body for the most part, thus for example at 90% and more includes a plastic from the group consisting of HDPE, PP, PET-X, PET-G, copolymers of the specified plastics, bio-plastics such as e.g. PLA, PEF, or PPF, filled plastics and/or mixtures of the mentioned plastics.

The plastic which is used for the container body can be coloured or non-coloured. A crystal clear container body is achieved due to making do without the admixing of a dye, e.g. in the case of PET. The recyclability of the pressure container can be improved even more by way of this.

Concerning container bodies 2 which are manufactured from a preform from PET, the container body is reshaped in the stretch blow moulding method in a manner such that it has an axial stretching ratio in an exemplary range of 1:1.5 to 1:15, in particular from for example 1:4 to 1:10 with respect to the preform.

A region of the container body 2, over which the axially displaceable plunger travels on use has a degree of crystallisation degree which is equal to or larger than for example 5%, wherein the degree of crystallisation is determined via density measurements according to the standard ASTM D 1505-10 given an intrinsic viscosity of 0.75 dl/g to 1.25 dl/g which is measured according to ASTM D 4603-11. The container body 2 in the region over which the plunger 10 travels has a degree of crystallisation of for example 5% to 50%, preferably for example 20% to about 30% in the region.

The determining of the density is effected according to the measuring method which is described in the standard ASTM D 1505-10, for the definition of the degrees of crystallisation which are specified above. This measuring method permits the density to be determined with an accuracy of 0.001 g and less. The measured density provides information on the orientation, the crystallisation and the strength. However, amorphous PET can achieve different density values in dependence on the added copolymers and/or additives. Values between 1.320 g/cm$^3$ and 1.339 g/cm$^3$ are known.

In order, despite the copolymers and/or additives which are added to the amorphous PET, to be able to use the measuring method which is described in the standard ASTM D 1505-10, it is specified that an average density of the container body which is determined below the opening 8 of the container body represents a first reference value. Preferably, for example the density is determined at least at three measuring points which are different from one another, along a periphery of the container body and the average density is determined from this. Irrespectively of a possible actually present crystallisation, it is defined that no crystallisation is present, thus that the degree of crystallisation is 0%, at the measuring position or positions, at which the first reference value has been determined. Furthermore, a second reference value is defined, which is for example 0.120 g/cm$^3$ larger than the first determined reference value. This second reference value according to definition corresponds to a crystallisation degree of 100%. The degrees of crystallisation which lie between the two reference values are directly proportional to the determined density values.

For example, an average density of 1.330 g/cm$^3$ is determined as a first reference value. According to the above definition, this average density corresponds to a crystallisation degree of 0%. According to definition, the degree of crystallisation of 100% lies at a density of 1.450 g/cm$^3$ which represents the second reference value. On account of the direct proportionality between the density values and the degrees of crystallisation, the degree of crystallisation at a density of 1.360 g/cm$^3$ is then 25%, at a density of 1.390 g/cm$^3$ is 50% and at a density of 1.420 g/m$^3$ is 75%.

In order for the container body 2 of the pressure container 1 to have the demanded intrinsic stiffness and pressure resistance, the container body 2 at least in the region over which the plunger 10 moves on application has a wall thickness of 0.35 to 0.95 mm.

The valve attachment or its components which are not represented in FIG. 1 expediently includes (e.g., consists of) the same plastic or plastic mixture as the container body 2.

The plunger 10 is axially displaceable in the interior of the container body 2. It includes an upper delimitation surface 11 which faces the opening 8 of the container body 2 and a lower delimitation surface 12 which faces the base part 6. The plunger 10 includes two circumferential sealing lips 13, 14 which are axially distanced to one another and which bear on an inner wall 3 of the container 2, for the pressure-tight separation of the receiving chamber 4 from the reservoir 5. One of the two circumferential sealing lips 13, 14 is assigned to the upper 11 and one to the lower delimitation surface 12 of the plunger 10. Herein, the upper sealing lip 13 extends from the upper delimitation surface 11 in the direction of the opening 8 of the container body 2 and to the outside in the direction of the inner wall 3 of the container body 2. The lower sealing lip 14 extends from the lower delimitation surface 12 in the direction of the base part 6 and to the outside and in the direction of the inner wall 3 of the container body 2. The upper sealing lip 13 hence extends into the receiving chamber 4, whilst the lower sealing lip 14 extends into the reservoir 5. Given a receiving chamber 4 which is filled with the filling product and a reservoir 5 which is filled with the pressure medium, the upper 13 and the lower 14 sealing lip are pressable or pressed in a fluid tight manner onto the inner wall 3 of the container body by way of the prevailing pressure.

The plunger 10 includes (e.g., consists for the most part of), thus for example at 90% and more of the same plastic as the container body 2. The upper 13 and/or the lower sealing lip 14 can for example include (e.g., consist of) a reversibly elastic material, such as e.g. silicone, rubber, EPDM, FKM. The reversible elasticity of the sealing lip(s) 13, 14 simplifies the compensation of unevenness of the inner wall 3 of the container body 2 which consequently does not need to be calibrated. As a result of the elasticity of the sealing lips 13, 14, their free end regions which bear on the inner wall 3 come into surfaced contact on the inner wall 3 of the container body 2 due to the pressure of the pressure medium or of the filling product, which increases the pressure sealedness.

Figure 2:
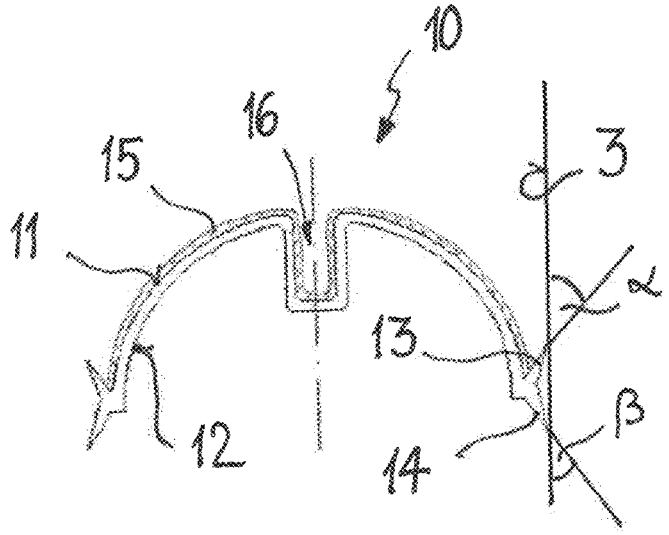
FIG. 2 is an axially sectioned representation of a plunger.

FIG. 2 shows an axially sectioned view of the exemplary plunger 10. The plunger 10 includes a dome-like outer contour which in the inserted state is cambered in the direction of the opening 8 of the container body 2 (FIG. 1). The cambered outer contour of the plunger 10 improves the uniform pressure distribution of the pressure medium upon the plunger 10. As is shown, the plunger 10 can be provided with a roughly centrally arranged recess 16. Given a plunger 10 which is inserted into the container body 2, this recess serves for receiving a continuation which usually projects from the valve attachment which is assembled on the opening 8 of the container body 2. By way of this, the plunger 10 can be brought closer to the valve attachment, in order to be able to empty the contents of the receiving chamber 4 where possible without any remains. The cambered outer contour of the plunger 10 likewise assists in this, by way of it being approximated to the shape of the container body 2 in the proximity of the opening 8. The sealing lips 13, 14 which are axially distanced to one another, in the unloaded state each enclose an angle $\alpha$ and $\beta$ respectively of for example about 45 degrees to about 80 degrees with the inner wall 3 of the container body 2. The angles $\alpha$ and $\beta$ can herein be different to one another.

As is indicated in FIG. 2, the plunger 10 can include a barrier layer 15 which prevents a passage of the pressure medium from the reservoir to the receiving chamber. Given the application of compressed air as a pressure medium and given filling products which could degrade on contact with air, e.g. ketchup, various spice sauces and spice pastes, etc., it is the case of a barrier layer which prevents the passage of oxygen through the plunger 10. The barrier layer 15 can be an EVOH layer, or an EVAL layer, or a layer which is based on polyamide, or a lacquer coating, or a silicon oxide coating, or an aluminium oxide coating, or a coating of silicones or a combination of the mentioned coatings.

The barrier layer 15 can be deposited onto the plunger 10 by way of sputtering. Alternatively, the plunger 10 can also be manufactured in an injection moulding method or in a compression moulding method, and the barrier layer 15 can be deposited during the manufacture of the plunger 10, for example in a 2-component injection moulding method.

It is to be understood that the container body 2 can also be provided with an additional barrier layer. This corresponds to the barrier layers which have been specified in the context of the plunger 10. The barrier layer of the container body 2 can already be arranged on manufacture of the preform, from which the container body 2 is subsequently blow moulded, or it can be deposited on an outer wall or also on the inner wall 3 of the container body 2 not until afterwards. For example, this can be effected by way of lacquering or by way of sputtering. Given preforms which are constructed in a multi-layered manner, the barrier layer can also be formed by one of the layers. Given a container body 2 which is manufactured in the extrusion blow moulding method 2, the barrier layer can already be co-extruded or not be deposited on the outer wall of the container body or the inner wall 3 until after the manufacture of this container body 2. A coating which is deposited on the inner wall 3 can also yet additionally include a friction-reducing function with respect to the axially displaceable plunger 10.

Figure 3:
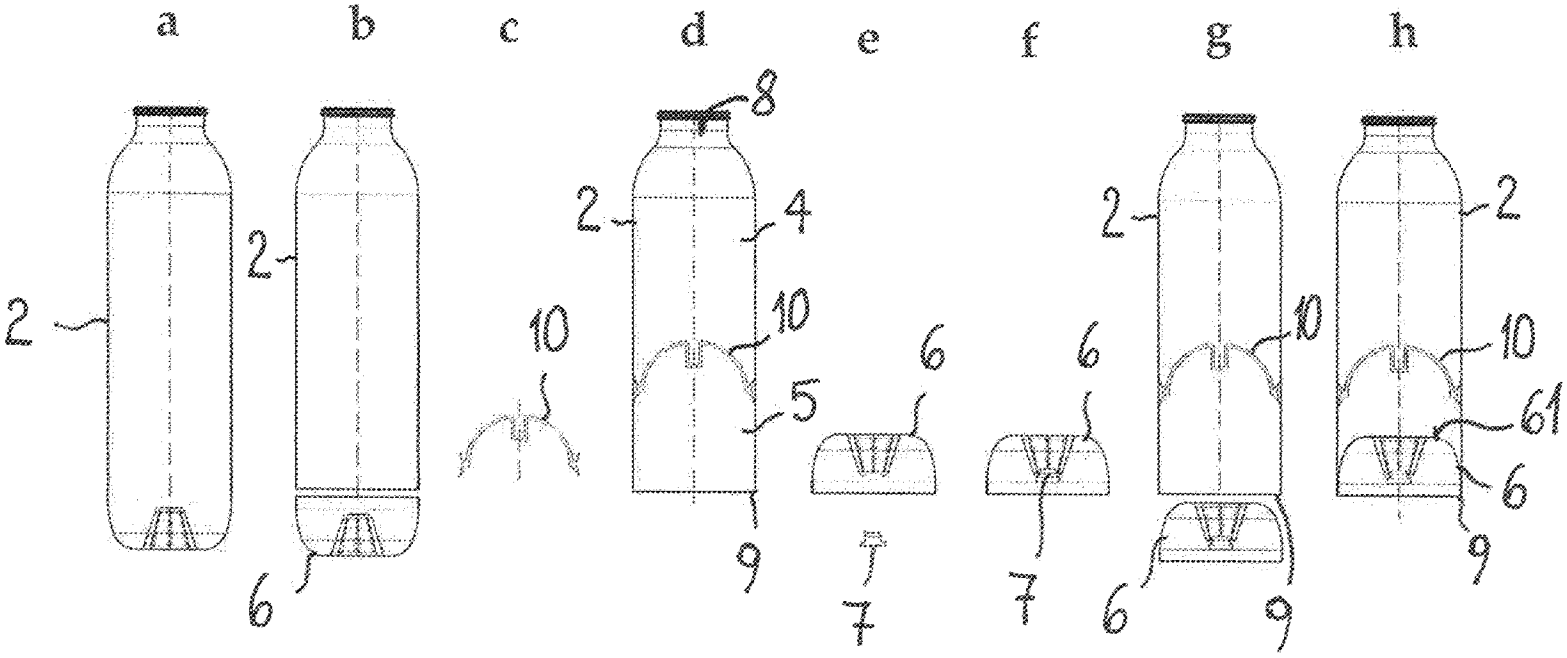
FIG. 3 is a sequence of axially sectioned views a-h for explaining a manufacture of the embodiment of the pressure container according to FIG. 1 and according to the present disclosure.

FIG. 3 by way of the axially sectioned views a-h shows the manufacture of an exemplary pressure container 1 according to FIG. 1. View a shows the container body 2 which can be stretch blow moulded, injection blow moulded or extrusion blow moulded. In view b, it is shown that the base part 6 is separated away from the remaining container body 2, in particular is cut away. View c shows the plunger 10 with a cambered outer contour which according to view d is inserted through the cut end 9 of the container body 2 in a manner such that the convexly projecting dome of the plunger 10 faces the opening 8 of the container body 2. The inserted plunger 10 is axially displaceable and separates the interior of the container body into the receiving chamber 4 and into the reservoir 5. In the views e and f, it is shown that a plug 7 is inserted roughly centrically into the cut-away base part 6, the plug being piercable by a needle or the like for filling the reservoir 5 with the pressure medium. View g shows that the previously separated away base part 6 is inserted into the cut end 9 of the container body 2 in a manner such that a container base 61 of the base part 6 lies closer to the plunger 10 than the cut end 9 of the container body 2. View h finally shows the container body 2, whose reservoir 5 is closed in a pressure-tight manner by way of the inserted base part 6. The pressure-tight connection between the container body 2 and the base part 6 is created for example in a welding method. Different plastic welding methods are known from the state of the art. For example, a so-called clear-clear laser welding method which can lead to adequately strong material-fit connections has been described for plastic containers from PET. Alternatively, the pressure-tight connection between the base part 6 and the cut end of the container body 2 can be created in a friction welding method or in an ultrasonic welding method. As a result of the material pairing of the joining partners which is of the same type, a local melting of the joining partners in the joining region is sufficient, in order to create a substance-bonded connection which has the demanded pressure resistance. The base part 7 and the container body 2 can also be connected to one another in a pressure-tight manner by way of bonding.

Figure 4:
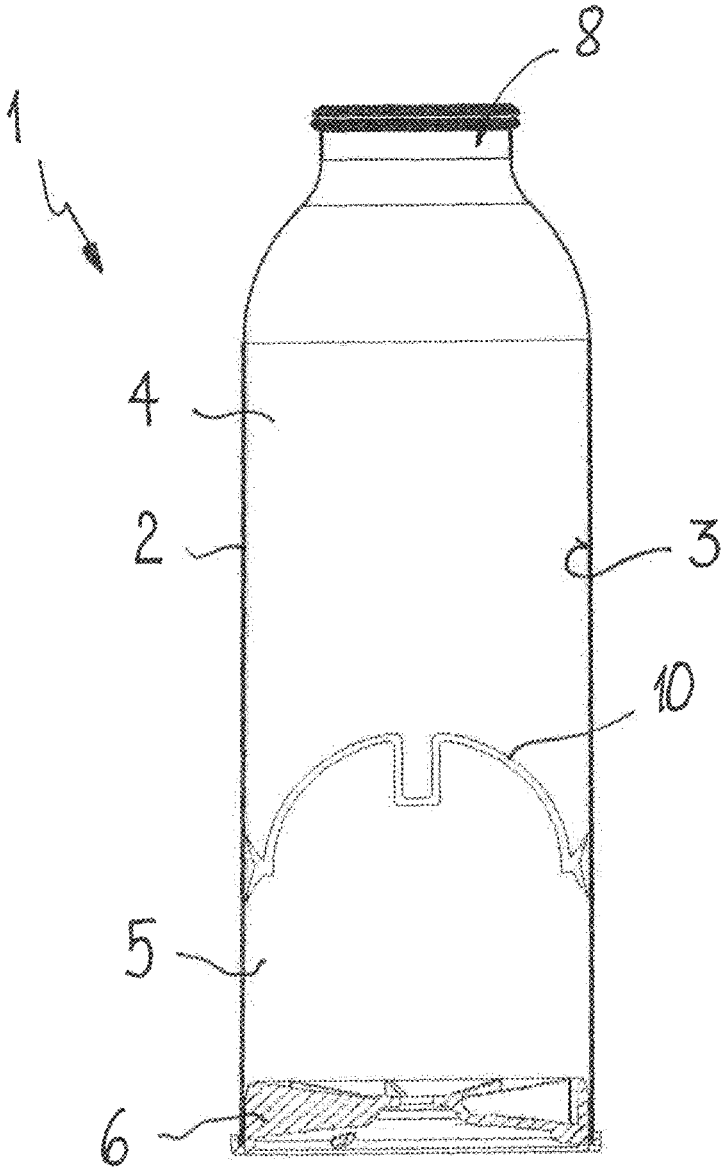
FIG. 4 is a second exemplary embodiment of a pressure container in an axial section.

FIG. 4 shows another exemplary embodiment of a pressure container 1 according to the present disclosure, in an axial section. The pressure container 1 corresponds essentially to the embodiment according to FIG. 1. For this reason, the same components and construction parts or components which correspond to one another are also provided with the same reference numerals. The pressure container 1 again includes a container body 2 whose interior which is enclosed by the container body 2 is subdivided by way of an inserted, axially displaceable plunger 10 into a receiving chamber 4 for a gaseous, liquid, powder-like, pasty or similar filling product and into a reservoir 5 which is separated therefrom in a pressure tight manner for a pressure medium. The reservoir 5 is closed in a pressure-tight manner by a base part 6. At the longitudinal end which is away from the base part 6, the container body 2 includes an opening 8 which is closable in a pressure-tight manner by a valve attachment which is designed for dispensing a gaseous, fluid, powder-like, pasty or similar filling product. This is effected after the filling of the receiving chamber 4 with the filling product. For reasons of a better overview and since this is not essential to the invention, a representation of the valve insert has been omitted.

In contrast to the embodiment which is represented in FIG. 1, the base part 6 is not a base section which is cut away from the stretch blow moulded, injection blow moulded or extrusion blow moulded container body 2, but a separate component which is manufactured for example in an injection moulding method. Herein, a plastic which is compatible with the plastic material of the container body 2 is expediently applied for the base part 6. For example, the base part 6 consists for the most part, thus at 90% and more of the same plastic as the container body 2. This simplifies the pressure-tight connection between the container body 2 and the base part 6. For this, again a base section can be cut away from the container body 2 as is indicted for example in view b in FIG. 3. After the insertion of the plunger 10 through the cut end into the container body 2, the container body 2 and the separate base part 6 are again connected to one another in a pressure-tight manner. The pressure-tight connection between the cut end of the container body 2 and the separate base part 6 can be created for example in a welding method. Alternatively, the pressure-tight connection between the base part and the cut end of the container body can also be created in a friction welding method or in an ultrasonic welding method. Finally, the separate base part 6 and the cut end of the container body 2 can also be connected to one another in a pressure-tight manner by way of bonding The invention has been described with the examples of specific embodiments. The aforementioned description however merely serves for the explanation of the invention and is not to be considered as limiting. In contrast, the invention is defined by the patent claims and the equivalents which are derived by a person skilled in the art and encompassed by the general inventive concept.

It will thus be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A pressure container of plastic, comprising:

an essentially cylindrical container body whose one longitudinal end includes an opening which is closable in a pressure-tight manner by a valve attachment which is configured and designed for dispensing a gaseous, liquid, powder-like, pasty or similar filling product, and whose interior, by way of a plunger which is arranged in a longitudinally displaceable manner along a longitudinal axis of the container body, is subdivided into a receiving chamber which is adjacent to the opening for the filling product and into a reservoir which is separated from this in a pressure tight manner and which is closed in a pressure-tight manner by a base part, for a pressure medium, the container body being a hollow blow molded body; and the plunger includes two circumferential sealing lips which are distanced from one another in an axial direction, wherein an upper sealing lip extends into the receiving chamber and a lower sealing lip extends into the reservoir, wherein the upper and the lower sealing lips are pressed or are pressable in a fluid-tight manner onto an inner wall, which delimits the interior of the container body, by way of a pressure which prevails in the receiving chamber and in the reservoir, wherein the container body is a stretch blow molded body of an injection molded or compression molded preform, and in a region over which the plunger is configured to travel on use, has a degree of crystallization which is equal to or larger than 5%, wherein the degree of crystallization is determined via density measurements according to the standard ASTM D 1505-10 given an intrinsic viscosity of 0.75 dl/g to 1.25 dl/g which is measured according to ASTM D 4603-11.

2. A pressure container according to claim 1, wherein the plunger comprises:

an upper delimitation surface which faces the opening, and a lower delimitation surface which faces the base part, and one of the two circumferential sealing lips is assigned to the upper delimitation surface and one to the lower delimitation surface, wherein the upper sealing lip extends from the upper delimitation surface in a direction of the opening and to an outside in a direction of the inner wall of the container body, and the lower sealing lip extends from the lower delimitation surface in a direction of the base part and to the outside and in a direction of the inner wall of the container body.

3. A pressure container according to claim 2, wherein the sealing lips in a non-loaded state form an angle ($\alpha$, $\beta$) of 45 degrees to 80 degrees with the inner wall of the container body.

4. A pressure container according to claim 1, wherein the container body is configured as a stretch blow molded body of an injection molded or compression molded preform which consists essentially of polyethylene terephthalate.

5. A pressure container according to claim 1, wherein the container body has an axial stretching ratio specified to be in a range of 1:1.5 to 1:15, and/or of 1:4 to 1:10 with respect to the preform.

6. A pressure container according to claim 1, wherein the container body is specified to have a degree of crystallization at least one of 5% to 50%, and/or of 20% to 30%, in the region over which the plunger is configured to travel.

7. A pressure container according to claim 1, wherein the container body is configured as an injection blow molded body of an injection molded or compression molded preform.

8. A pressure container according to claim 1, wherein the container body is an extrusion blow molded body.

9. A pressure container according to claim 1, wherein the container body for 90% or more contains a plastic from the group consisting of at least one or more of PET, PVC, copolymers of the specified plastics, bio-plastics including PLA, PEF or PPF, filled plastics, and/or mixtures thereof.

10. A pressure container according to claim 9, wherein the plastic is uncoloured.

11. A pressure container according to claim 1, wherein the container for 90% or more contains a plastic from the group consisting of at least one or more of HDPE, PP, PET-X, PET-G, copolymers of the specified plastics, bio-plastics including PLA, PEF, or PPF, filled plastics, and/or mixtures thereof.

12. A pressure container according to claim 11, wherein the plunger for at least 90% or more contains a same plastic as the container body.

13. A pressure container according to claim 12, wherein the upper sealing lip and/or the lower sealing lip consists of a reversibly elastic material of at least one or more of silicone, rubber, EPDM, and FKM.

14. A pressure container according to claim 11, comprising:

a pressure medium within the reservoir, wherein the pressure medium is oxygen.

15. A pressure container according to claim 1, wherein the plunger comprises:

a barrier layer configured to prevent a passage of a pressure medium of oxygen from the reservoir to the receiving chamber.

16. A pressure container according to claim 15, wherein the barrier layer is configured and designed as a layer from the group consisting of at least one or more of EVOH layer, EVAL layer, a layer based on polyamide, lacquer coating, silicon oxide coating, aluminium oxide coating, coating from silicones, and/or combinations thereof.

17. A pressure container according to claim 15, wherein the barrier layer is configured as a sputter deposited layer.

18. A pressure container according to claim 15, wherein the plunger is configured as an injection molded or compression molded plunger, and the barrier layer is arranged relative to the plunger placement during manufacture.

19. A pressure container according to claim 1, wherein the valve attachment for the opening is composed of components which for at least 90% or more contain a same plastic as the container body.

20. A pressure container according to claim 1, wherein the base part includes a base section which has previously been separated from the container body and which is inserted into a cut end of the container body which lies opposite the opening, in a manner such that a container base of the base section lies closer to the plunger than the cut end of the container body.

21. A pressure container according to claim 1, wherein the base part is configured as an injection molded part.

22. A pressure container according to claim 21, wherein the base part at least 90% or more consists of a same plastic as the container body.

23. A pressure container according to claim 1, wherein the container body has a wall thickness of 0.35 mm to 0.95 mm at least in a region over which the plunger is configured to travel on application.

24. A pressure container according to claim 1, wherein the base part and the container body are connected to one another in a pressure-tight manner by a weld.

25. A pressure container according to claim 24, wherein the weld is configured as a friction weld or an ultrasonic weld.

26. A pressure container according to claim 1, wherein the base part and the container body are connected to one another in a pressure-tight manner by a bond.

27. A pressure container according to claim 1, wherein the opening is closed in a pressure-tight manner by the valve attachment, and the receiving chamber of the container body is filled with a gaseous, liquid, powder-like, pasty or similar filling material, and the reservoir for the pressure medium contains a non-combustible gas or gas mixture of at least one or more of air, nitrogen, carbon dioxide or an inert gas held at a pressure of 1.5 to 10 bar.

28. The pressure container according to claim 1, wherein the plunger is made of a first material and the sealing lips are made from a second material different from the first material.

* * * * *